US008769728B2

(12) United States Patent
Shiue

(10) Patent No.: US 8,769,728 B2
(45) Date of Patent: Jul. 8, 2014

(54) GOGGLE MASK, CHECK VALVE DEVICE THEREOF AND METHOD FOR MANUFACTURING A CHECK VALVE DEVICE THEREOF

(75) Inventor: Chih-Cheng Shiue, Taipei (TW)

(73) Assignee: Qbas Co., Ltd., Taipei (TW)

( * ) Notice: Subject to any disclaimer, the term of this patent is extended or adjusted under 35 U.S.C. 154(b) by 418 days.

(21) Appl. No.: 13/214,333

(22) Filed: Aug. 22, 2011

(65) Prior Publication Data

US 2012/0047638 A1 Mar. 1, 2012

(30) Foreign Application Priority Data

Aug. 30, 2010 (TW) ..... 099129086 A
Mar. 16, 2011 (TW) ..... 100108928 A

(51) Int. Cl.
*A61F 9/02* (2006.01)
*B63C 11/12* (2006.01)

(52) U.S. Cl.
CPC ..... *B63C 11/12* (2013.01)
USPC ..... 2/427

(58) Field of Classification Search
CPC ..... A61F 9/02; A63B 33/002; B63C 11/12
USPC ..... 2/426, 427, 428, 430, 435, 436, 437, 2/438, 439, 440, 445, 446
See application file for complete search history.

(56) References Cited

U.S. PATENT DOCUMENTS 3,059,637 A * 10/1962 Senne ..... 2/9
3,186,005 A * 6/1965 Gentile ..... 2/9
3,671,976 A * 6/1972 Johnson et al. ..... 2/430
4,077,068 A * 3/1978 Anderson ..... 2/428
5,479,917 A * 1/1996 Hsieh ..... 128/200.29
5,558,466 A * 9/1996 Kuo et al. ..... 405/186
5,564,130 A 10/1996 Feng
5,572,989 A * 11/1996 Lutz et al. ..... 128/201.18
5,575,277 A * 11/1996 Lutz et al. ..... 128/201.18
5,608,920 A * 3/1997 Oliver et al. ..... 2/428
5,638,552 A * 6/1997 Fujima ..... 2/428
5,860,168 A * 1/1999 Winefordner et al. ..... 2/428
5,890,234 A 4/1999 Lan (Continued)

FOREIGN PATENT DOCUMENTS

JP 2005280563 10/2005
TW 483416 4/2002
TW I276447 3/2007

OTHER PUBLICATIONS

Japan Office Action issued on Dec. 18, 2012.

(Continued)

*Primary Examiner* — Alissa L Hoey
(74) *Attorney, Agent, or Firm* — MClure, Qualey & Rodack, LLP

(57) ABSTRACT

A goggle mask is provided. The goggle mask includes at least one check valve device with a soft body and at least one valve disk. The soft body is integrally connected with the soft nose masking portion of the goggle mask. The soft body has a draining hole. The valve disk is adapted to movably cover the draining hole. With this arrangement, there are no hard objects that come into contact with the user's face, so the user may feel less uncomfortable. A check valve device and a method for manufacturing a check valve device of a goggle mask are also provided.

13 Claims, 12 Drawing Sheets

(56) References Cited

U.S. PATENT DOCUMENTS

| | | | | |
|---|---|---|---|---|
| 5,979,441 | A * | 11/1999 | Hsieh | 128/201.28 |
| 6,371,109 | B1 * | 4/2002 | Taylor | 128/201.27 |
| 6,381,761 | B2 * | 5/2002 | Kawashima et al. | 2/428 |
| 6,598,239 | B1 | 7/2003 | Hsieh | |
| 6,666,210 | B2 * | 12/2003 | Semeia | 128/207.13 |
| 6,698,033 | B2 * | 3/2004 | Fujima | 2/428 |
| 6,834,649 | B1 * | 12/2004 | Kuo | 128/205.24 |
| 6,921,165 | B1 * | 7/2005 | Feng | 351/43 |
| 7,172,278 | B2 * | 2/2007 | Feng | 351/43 |
| 7,328,699 | B2 * | 2/2008 | Kawashima et al. | 128/201.27 |
| 7,891,024 | B2 * | 2/2011 | Garofalo et al. | 2/426 |
| 2003/0066124 | A1 * | 4/2003 | Fujima | 2/428 |
| 2005/0217670 | A1 | 10/2005 | Kawashima et al. | |
| 2006/0117469 | A1 * | 6/2006 | Garofalo et al. | 2/428 |
| 2008/0196714 | A1 * | 8/2008 | Shiue | 128/201.27 |

OTHER PUBLICATIONS

English translation of Japan Office Action issued on Dec. 18, 2012.
Taiwan Office Action issued on Jun. 11, 2013.
English translation summarizing the Taiwan Office Action issued on Jun. 11, 2013.
European Search Report issued Dec. 13, 2011.
English translation of abstract of TW 483416.
China Office Action issued on Nov. 1, 2013.
English remarks on China Office Action issued on Nov. 1, 2013.

* cited by examiner

GOGGLE MASK, CHECK VALVE DEVICE THEREOF AND METHOD FOR MANUFACTURING A CHECK VALVE DEVICE THEREOF

CROSS-REFERENCES TO RELATED APPLICATIONS

This application claims priority to a Taiwan Patent Application No. 099129086 filed on Aug. 30, 2010, and another Taiwan Patent Application No. 100108928 filed on Mar. 16, 2011, which are hereby incorporated herein by reference in its entirety.

BACKGROUND OF THE INVENTION

1. Field of the Invention

The present invention provides a goggle mask, and in particular, to a goggle mask for use underwater or during water sports.

2. Descriptions of the Related Art

Conventional goggle masks for use underwater or during water sports are usually provided with a drain valve to allow the user to drain the water that undesirably enters into the goggle masks. In consideration of the structural stability of some draining mechanisms, the conventional drain valve must be made of a hard material; furthermore, the conventional drain valve is separately fabricated and then assembled onto a goggle mask.

Because the drain valve is made of a hard material, the drain valve may make contact with the user's face, causing discomfort when the user is wearing the goggle mask. The discomfort is especially troublesome when the drain valve comes into contact with the user's philtrum, which is the most sensitive and fragile portion of the face, so even the slightest touch or pressure from the hard drain valve will cause discomfort to the user. Particularly, this may become more intolerable after the user has participated in a water sport or has been diving for a long time. However, for safety reasons, the user has no choice but to wear the goggle mask continuously, and this is often very painful to the user. Additionally, it is difficult to compress the drain value when the user has to pack up the goggle mask, which makes the packed goggle mask bulky in volume and inconvenient to carry.

Furthermore, conventionally, the drain valve is assembled onto, i.e., detachably connected to, the goggle mask, and the position of the drain valve usually corresponds to the nose portion that protrudes the most in the goggle mask. Therefore, it is possible for the drain valve to be detached from the goggle mask due to impact or squeezing by external objects during the use or storage of the goggle mask; this is troublesome to the user and may even cause a risk of water leakage. Moreover, an assembling gap may arise between the drain valve and the goggle mask after being assembled, and this further increases the possibility of water leakage.

To overcome the aforesaid drawbacks, some improvements on the drain valve have been proposed, for example, the solution proposed in Taiwan Patent No. 483416. According to this solution, the hard drain valve is formed integrally with a soft mask to solve the problem of water leakage. However, this solution still cannot effectively solve the problem of discomfort caused by the drain valve coming into contact with the user; furthermore, because of the significant difference in material between the hard drain valve and the soft mask, it is difficult to integrally form the drain valve and the soft mask.

Besides what is described above, conventional drain valves also have other drawbacks. For example, there is a plurality of draining holes in the drain valve, so plural ribs exist between the draining holes correspondingly. Since the existence of the ribs will block the flow of liquids, the user has to exhale with great force to drain the liquid out through the drain valve.

Furthermore, conventional drain valves all have a circular cross section which does not match with the cross section (usually of a triangular shape) of the nose masking portion of the goggle mask, so the distance between the drain valve and the nose tip part of the nose masking portion is relatively large after the drain valve is joined to the nose masking portion. This makes it difficult for the liquid that accumulates at the nose tip to be drained out of the goggle mask through the drain valve.

In view of this, it is highly desirable in the art to provide a goggle mask capable of overcoming at least one or all of the drawbacks described above.

SUMMARY OF THE INVENTION

The primary objective of the present invention is to provide a goggle mask, a check valve device thereof and a method for manufacturing the check valve device that can overcome the drawbacks of conventional goggle masks such as discomfort, inconvenience of storage and portability and poor air tightness.

To achieve the aforesaid objective, the goggle mask disclosed in the present invention comprises a supporting portion, a frame portion, a soft nose masking portion and at least one check valve device. The frame portion is disposed on the supporting portion, the soft nose masking portion is disposed on the supporting portion, and the check valve device is disposed on the interior side of the soft nose masking portion. The check valve device further includes a soft body and a valve disk. The soft body is integrally connected with the soft nose masking portion, extends inwards from the interior side of the soft nose masking portion, and is provided with at least one draining hole. The valve disk is connected with the soft body, and is adapted to movably cover the draining hole.

To achieve the aforesaid objective, another goggle mask disclosed in the present invention comprises a supporting portion, a frame portion, a soft nose masking portion and at least one check valve device. The frame portion is disposed on the supporting portion, the soft nose masking portion is disposed on the supporting portion, and the check valve device is disposed on the interior side of the soft nose masking portion. The check valve device further includes a soft body, a structural reinforcing component and a valve disk. The soft body is integrally connected with the soft nose masking portion, extends inwards from the interior side of the soft nose masking portion and has at least one draining hole. The structural reinforcing component is enclosed by the soft body and is harder than the soft body. The valve disk is connected with the structural reinforcing component, and is adapted to movably cover the draining hole.

To achieve the aforesaid objective, the method for manufacturing a check valve device of a goggle mask disclosed in the present invention comprises the following: locating an annular structural reinforcing component in the cavity of a mold; injecting the raw material of a soft body into the cavity to enclose the structural reinforcing component, wherein after the raw material is solidified, the soft body enclosing the structural reinforcing component is integrally formed, and wherein the structural reinforcing component is harder than the soft body, and at least one draining hole of the soft body is surrounded by the structural reinforcing component; taking the soft body enclosing the structural reinforcing component out of the mold; and connecting a valve disk to the structural reinforcing component.

To achieve the aforesaid objective, the check valve device of the goggle mask disclosed in the present invention comprises the following: a body, having a single draining hole; and a valve disk, connected with the body and adapted to movably cover the single draining hole.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
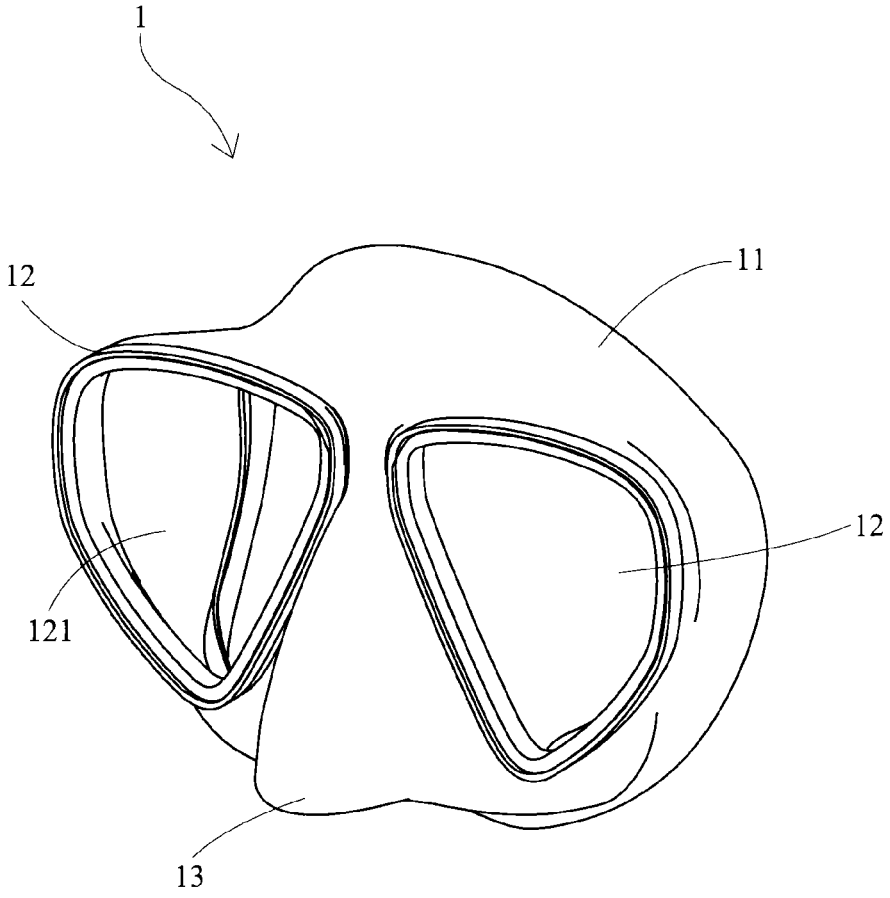
FIG. 1 is an assembly view of the first preferred embodiment of a goggle mask according to the present invention.
Figure 2:
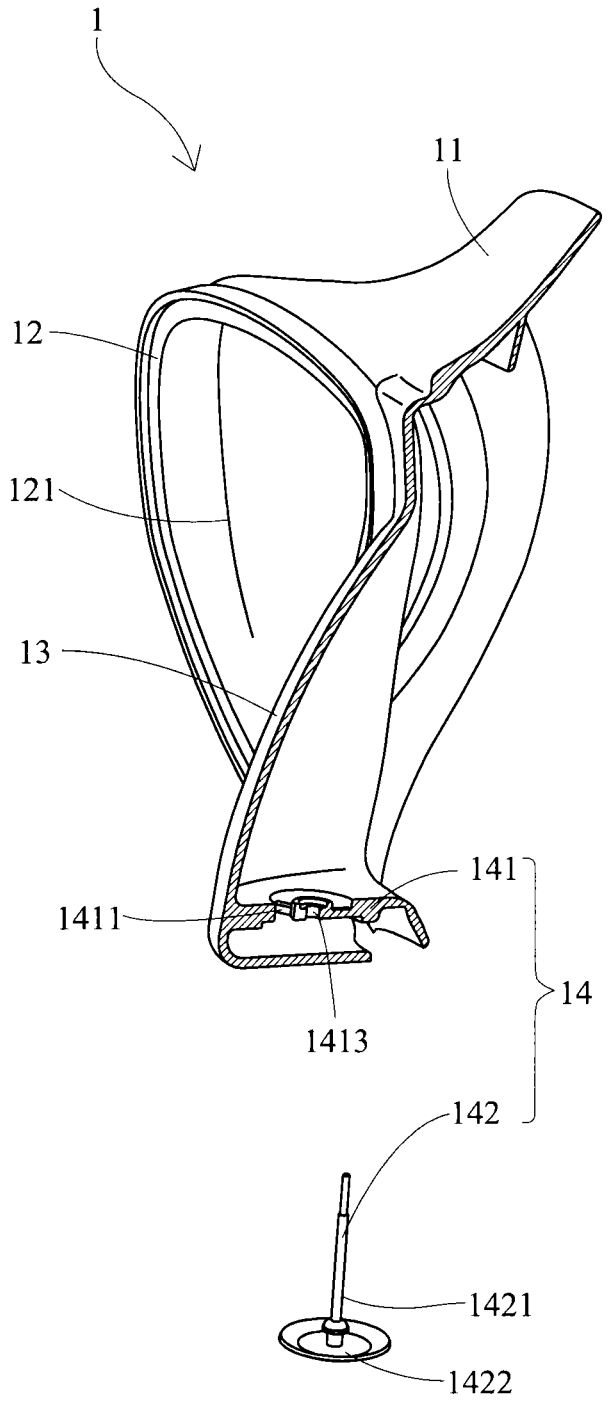
FIG. 2 is a cross-sectional exploded view of the first preferred embodiment of the goggle mask according to the present invention.
Figure 3:
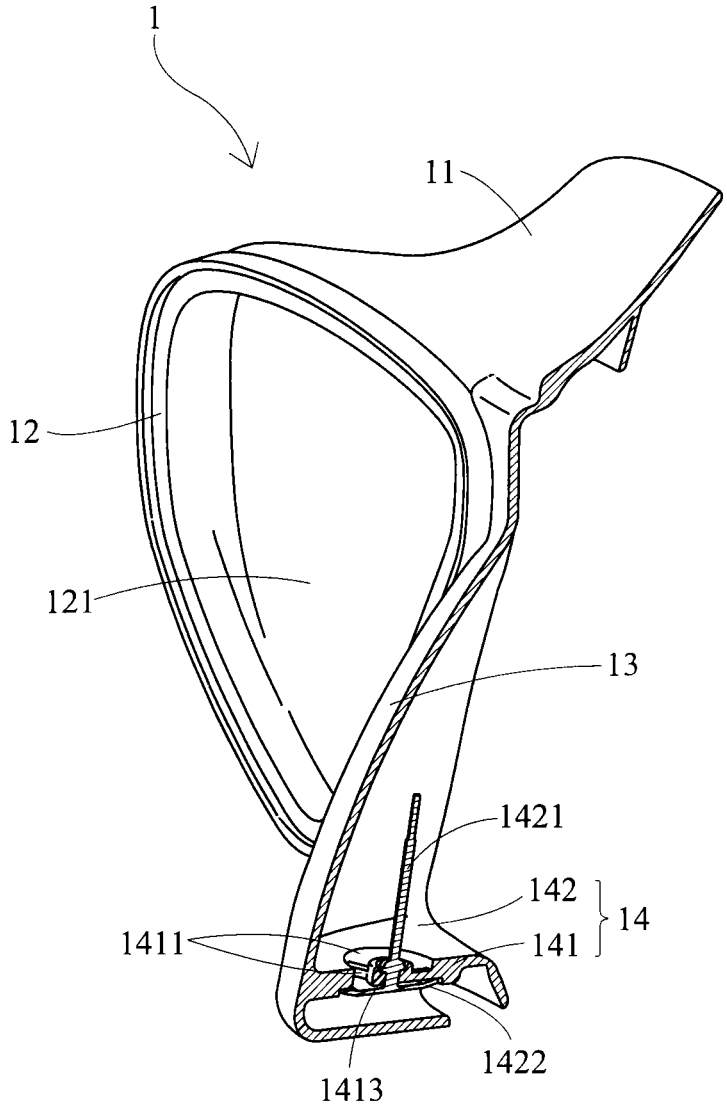
FIG. 3 is a cross-sectional assembly view of the first preferred embodiment of the goggle mask according to the present invention.

In reference to FIGS. 1 to 3, there is shown the first preferred embodiment of a goggle mask according to the present invention. The goggle mask 1 can be worn by a user underwater or during water sports to prevent water or other objects from directly coming into contact with the user's eyes and nose and to allow the user to clearly see the surroundings.

The goggle mask 1 comprises a supporting portion 11, a frame portion 12, a soft nose masking portion 13 and a check valve device 14; details of which will be described in sequence hereinafter.

The supporting portion 11 may be formed of a sheet structure, and has a shape corresponding to the contour of a human face. Therefore, when the goggle mask 1 is worn by the user, the supporting portion 11 can fit against the user's face seamlessly to prevent water from flowing between the supporting portion 11 and the user's face. Additionally, the supporting portion 11 may be made of a soft material so that it can be deformed adaptively according to the contour of the user's face to fit against the user's face more seamlessly.

The soft material of the supporting portion 11 may be a thermoplastic rubber (TPR), a thermoplastic polyurethane (TPU), a thermoplastic elastomer (TPE), a polyvinyl chloride (PVC), a silicone rubber or a combination thereof, and the supporting portion 11 may have a Shore hardness of 15 A to 95 A.

The frame portion 12 is disposed on the supporting portion 11 and may comprise two lenses 121. Each of the lenses 121 is made of a hard and transparent material to allow the user to look around through the two lenses 121.

The soft nose masking portion 13 is disposed on the supporting portion 11, and may also be formed of a sheet structure. Additionally, the soft nose masking portion 13 may be integrally connected with the supporting portion 11; i.e., the soft nose masking portion 13 and the supporting portion 11 may be formed integrally, adhered or fused together, or overmolded together in such a way that they are connected seamlessly to prevent penetration of water.

The soft nose masking portion 13 has a shape corresponding to the shape of the nose. Hence, when the goggle mask 1 is worn by the user, the user's nose can be received in the soft nose masking portion 13. The material of the soft nose masking portion 13 may be a thermoplastic rubber (TPR), a thermoplastic polyurethane (TPU), a thermoplastic elastomer (TPE), a polyvinyl chloride (PVC), a silicone rubber or a combination thereof, and the soft nose masking portion 13 may have a Shore hardness of 15 A to 95 A.

The check valve device 14 is disposed on the interior side of the soft nose masking portion 13. It shall be noted that the interior side of the soft nose masking portion 13 refers to a side facing towards the user's face, while the exterior side of the soft nose masking portion 13 refers to the side that faces away from the user's face. The check valve device 14 allows water to pass therethrough only in a single direction; therefore, by disposing the check valve device 14 on the interior side of the soft nose masking portion 13, water inside the soft nose masking portion 13 can be drained out of the soft nose masking portion 13 through the check valve device 14, but water outside cannot flow into the soft nose masking portion 13 through the check valve device 14.

The check valve device 14 comprises a soft body 141 and a valve disk 142. The soft body 141 is integrally connected with the soft nose masking portion 13, and extends inwards from the interior side of the soft nose masking portion 13. Additionally, the soft body 141 is provided with at least one draining hole 1411 (three in this embodiment) so that water can flow out of the soft nose masking portion 13 through the draining hole 1411. Similar to the soft nose masking portion 13, the material of the soft body 1411 may be a thermoplastic rubber (TPR), a thermoplastic polyurethane (TPU), a thermoplastic elastomer (TPE), a polyvinyl chloride (PVC), a silicone rubber or a combination thereof, and the soft body 141 may have a Shore hardness of 15 A to 95 A.

The valve disk 142 is connected with the soft body 141, and is adapted to movably cover the draining hole 1411. In detail, a part of the valve disk 142 can be deformed or move in response to the flow direction of the water. When the water flows out of the soft nose masking portion 13, the part of the valve disk 142 is pushed away from the soft body 141 instead of covering the draining hole 1411 so that the water can flow out smoothly; conversely, when the water outside is to flow into the soft nose masking portion 13, the part of the valve disk 142 will be pushed towards the soft body 141 by the water to cover the draining hole 1411, thereby blocking entry of the water. It shall be appreciated that the valve disk 142 may also be made of a soft material.

The valve disk 142 may be configured in various ways. In this embodiment, the valve disk 142 comprises a connecting rod 1421 and a movable piece 1422. The connecting rod 1421 is connected with the soft body 141 and does not move relative to the soft body 141; in other words, the connecting rod 1421 may be inserted through a hole 1413 of the soft body 141 and retained in the hole 1413.

The movable piece 1422 is disposed at one end (i.e., a lower end) of the connecting rod 1421 and located on the exterior side (i.e., the side facing away from the user's face) of the soft body 141. Furthermore, the movable piece 1422 is adapted to movably cover the draining hole 1411; that is, the movable piece 1422 can be deformed in response to the flow direction of the water. Specifically, when the water is to flow out of the soft nose masking portion 13, the movable piece 1422 is pushed away from the soft body 141 instead of covering the draining hole 1411; conversely, when the water outside is to flow into the soft nose masking portion 13, the movable piece 1422 will be pushed towards the soft body 141 by the water to cover the draining hole 1411.

It is also noting that the phrase "the soft body 141 is integrally connected with the soft nose masking portion 13" means that no gap exists at the interface between the soft nose masking portion 13 and the soft body 141. This makes it difficult for the water to flow through the interface therebetween, thus improving the air tightness of the goggle mask 1.

The "integral connection" may be accomplished in at least three ways. In the first way, the soft nose masking portion 13 and the soft body 141 are continuously formed in a single mold. In a second way, the soft body 141 is firstly formed and put into a mold for forming the soft nose masking portion 13, and then the soft nose masking portion 13 is formed in the mold in such a way that the periphery of the soft body 141 is enclosed by the soft nose masking portion 13. The second way is also known as overmolding. Because the soft body 141 and the soft nose masking portion 13 are both made of a soft material, the soft nose masking portion 13 can well enclose the soft body 141. In the third way, the soft body 141 and the soft nose masking portion 13 are formed separately and then adhered or fused together.

When the second way or the third way is adopted, the soft body 141 and the soft nose masking portion 13 may be made of different soft materials to make the soft body 141 harder than the soft nose masking portion 13.

As can be known from the above description of the goggle mask 1, the goggle mask 1 has the following advantages:

1. The soft body 141 and the soft nose masking portion 13 are both made of a soft material. Thus, when being contacted by the user's nose or face, both the soft body 141 and the soft nose masking portion 13 can be easily deformed to make the user feel less uncomfortable. In other words, no hard object that will compress the user's face and, particularly the philtrum, exists in the goggle mask 1.

2. When the goggle mask 1 is to be stored or carried, the soft nose masking portion 13 and the soft body 141 can be easily compressed to reduce the space occupied.

3. The soft body 141 and the soft nose masking portion 13 are integrally connected, so it is difficult for the water to flow into the goggle mask 1 through an interface between the soft body 141 and the soft nose masking portion 13. This can improve the air tightness of the goggle mask 1.

4. The soft body 141 and the soft nose masking portion 13 are integrally connected, so it is less likely for the soft body 141 to be detached from the soft nose masking portion 13 due to impacts such as collisions. This is favorable for the improvement of safety.

5. The soft body 141 and the soft nose masking portion 13 both have a Shore hardness of 15 A to 95 A, which represents a compromise between the structural strength of the goggle mask and the comfort of the user.

6. The soft body 141 further has a function of balancing the pressure inside the goggle mask 1 and the pressure outside the goggle mask 1, so that the pressure inside the goggle mask 1 can be stably maintained.

7. The soft body 141 and the soft nose masking portion 13 are made of similar materials, so they can be joined together easily. This can effectively save the manufacturing cost and improve the product yield.

Figure 4:
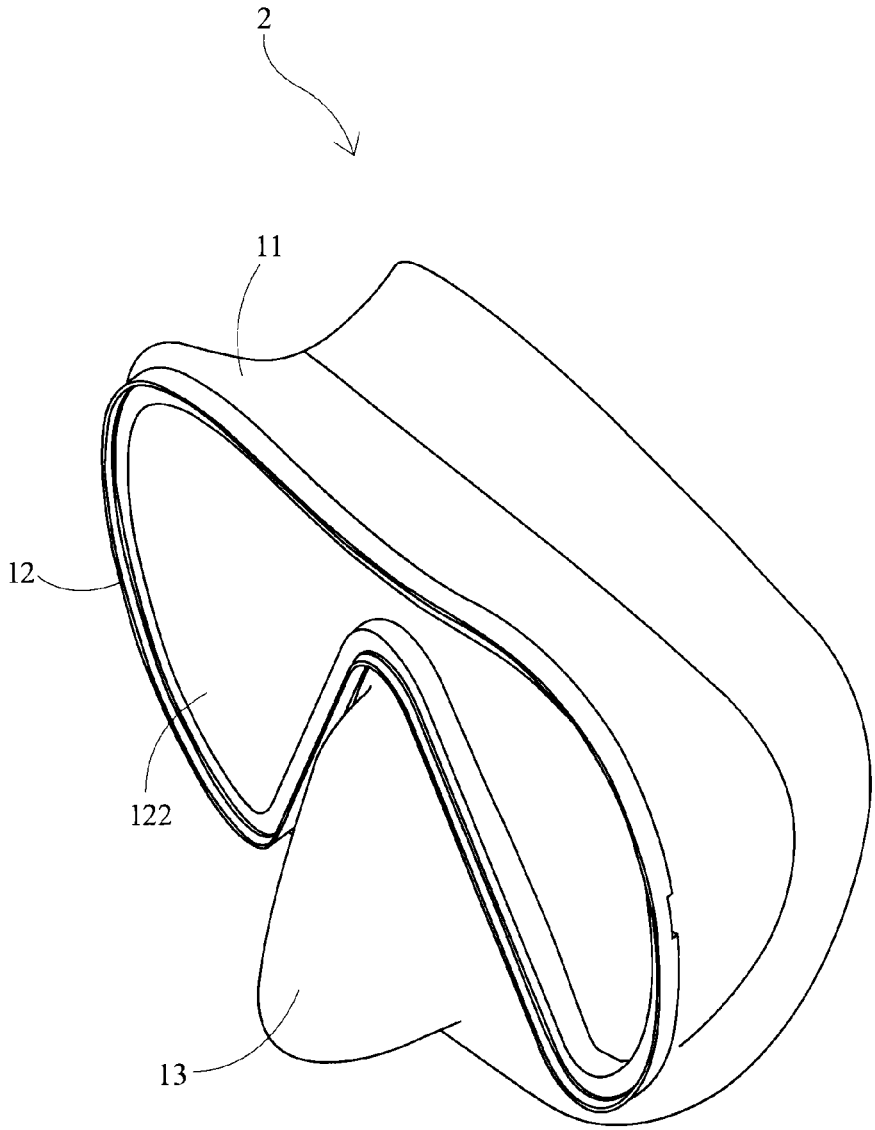
FIG. 4 is an assembly view of the second preferred embodiment of the goggle mask according to the present invention.

FIG. 4 illustrates the second preferred embodiment of the goggle mask according to the present invention. The goggle mask 2 of the second embodiment differs from the first embodiment in that the frame portion 12 of the goggle mask 2 comprises a lens 122. The lens 122 has a dimension (width) greater than that of the lens 121 shown in FIG. 1, and extends across the above of the soft nose masking portion 13 to enlarge the visual range of the user. For similarities between the goggle mask 2 of this embodiment and that of the previous embodiment, no description will be further made herein.

Figure 5:
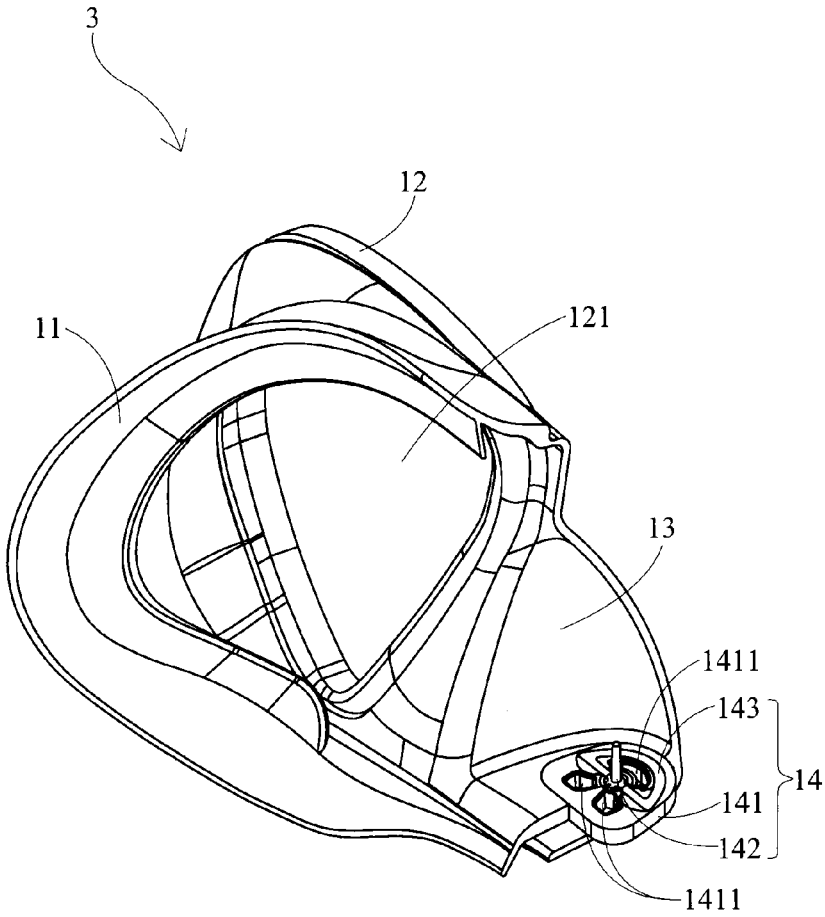
FIG. 5 is a cross-sectional assembly view of the third preferred embodiment of the goggle mask according to the present invention.
Figure 6:
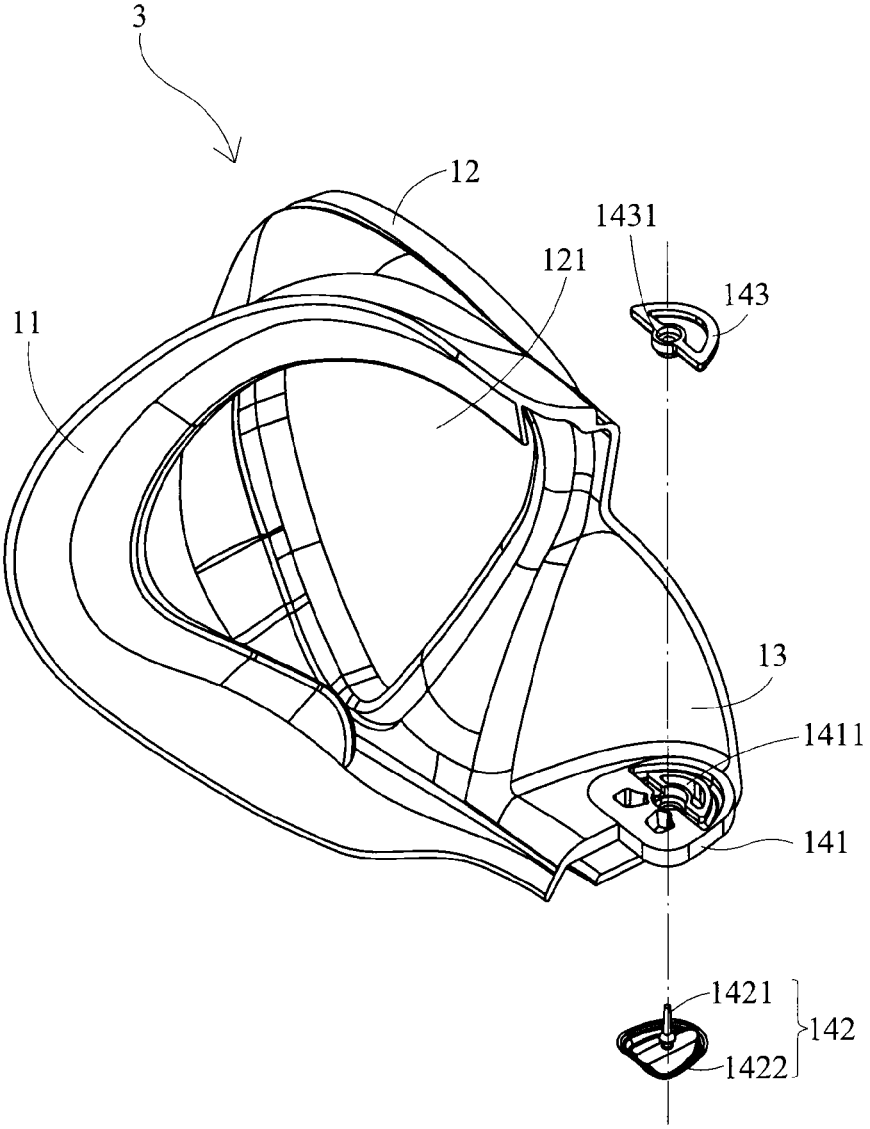
FIG. 6 is a cross-sectional exploded view of the third preferred embodiment of the goggle mask according to the present invention.

FIGS. 5 and 6 illustrate schematic views of the third preferred embodiment of the goggle mask according to the present invention. The goggle mask 3 of this embodiment differs from the above two embodiments in that the check valve device 14 further comprises a structural reinforcing component 143 in addition to the soft body 141 and the valve disk 142.

The structural reinforcing component 143 is adapted to reinforce the structural strength of the soft body 141, so it is made of a material harder than that of the soft body 141. The structural reinforcing component 143 may have a Shore hardness of 40 A to 100 A, and may be made of a polycarbonate (PC), an acrylonitrile butadiene styrene (ABS), Polyoxymethylene (POM), Nylon, Polyurethane (PU), Polypropylene (PP) or a combination thereof.

The structural reinforcing component 143 is enclosed by the soft body 141. In detail, the periphery of the structural reinforcing component 143 may be closely enclosed by the soft body 141, and the top surface or a bottom surface of the structural reinforcing component 143 may be optionally enclosed by the soft body 141 or not enclosed by the soft body 141. In this embodiment, the top surface of the structural reinforcing component 143 is partially exposed outside the soft body 141. Additionally, to not interfere with the draining hole 1411 of the soft body 141, the structural reinforcing component 143 may be of an annular structure (but is not limited to a circular structure), with at least one draining hole 1411 being surrounded by the annular structural reinforcing component 143 and other draining holes 1411 being located outside the structural reinforcing component 143.

The valve disk 142 of the check valve device 14 is connected to the structural reinforcing component 143. In detail, the connecting rod 1421 of the valve disk 142 can be connected to the structural reinforcing component 143 by being inserted through the hole 1431 of the structural reinforcing component 143 and retained therein. The movable piece 1422 is located at an exterior side of the structural reinforcing component 143.

Thus, in case the check valve device 14 of this embodiment is inadvertently squeezed by the user, the soft body 141 reinforced by the structural reinforcing component 143, which is hard and less liable to bending or deformation will not be bent or deformed. In other words, the soft body 141 will not be detached from the valve disk 142 due to undue deformation, and the valve disk 142 can still effectively cover the draining hole 1411 to prevent penetration of water into the soft nose masking portion 13. Furthermore, because the structural reinforcing component 143 is enclosed by the soft body 141, the structural reinforcing component 143 will not directly come into contact with the user's face while the user is wearing the goggle mask 3 of this embodiment, thus, making the user feel less uncomfortable.

Figure 7:
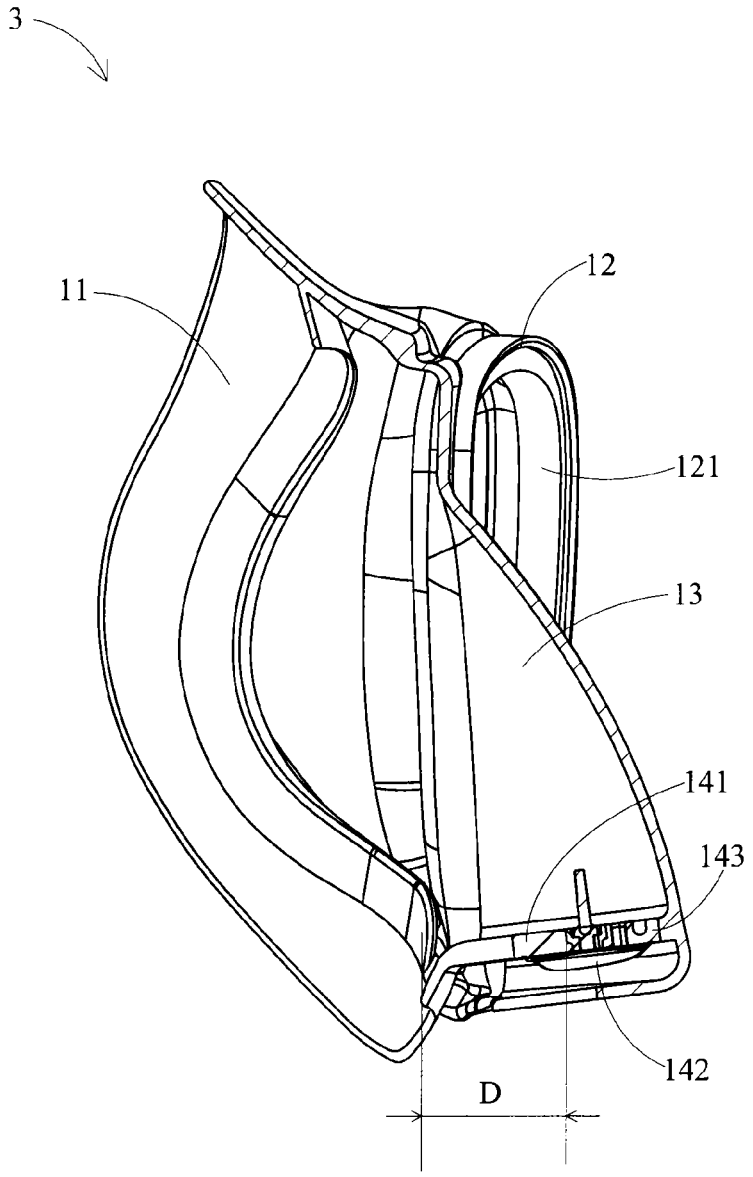
FIG. 7 is another cross-sectional assembly view of the third preferred embodiment of the goggle mask according to the present invention.

In reference to FIG. 7 to ensure that the user does not come into contact with the structural reinforcing component 143, a minimum distance D between the structural reinforcing component 143 and the supporting portion 11 shall be 11 mm to 25 mm (and preferably no less than 12 mm) when the goggle mask 3 is not worn by the user. Thus, when the goggle mask 3 is worn by the user, a distance of 6 mm to 22 mm can still be kept between the structural reinforcing component 143 and the supporting portion 11 despite the compression of the supporting portion 11. This can ensure that the user's face will not come into contact with the structural reinforcing component 143.

In reference to FIGS. 5 and 6, it is also worth noting that the soft body 141 of this embodiment has a non-circular sectional shape corresponding to the sectional shape of the soft nose masking portion 13, so the soft body 141 and, particularly, the draining hole 1411 thereof, can be arranged closer to the nose tip part of the soft nose masking portion 13. In this way, the liquid accumulated at the nose tip part of the soft nose masking portion 13 can be drained out of the goggle mask 3 through the draining hole 1411 more easily.

Figure 8:
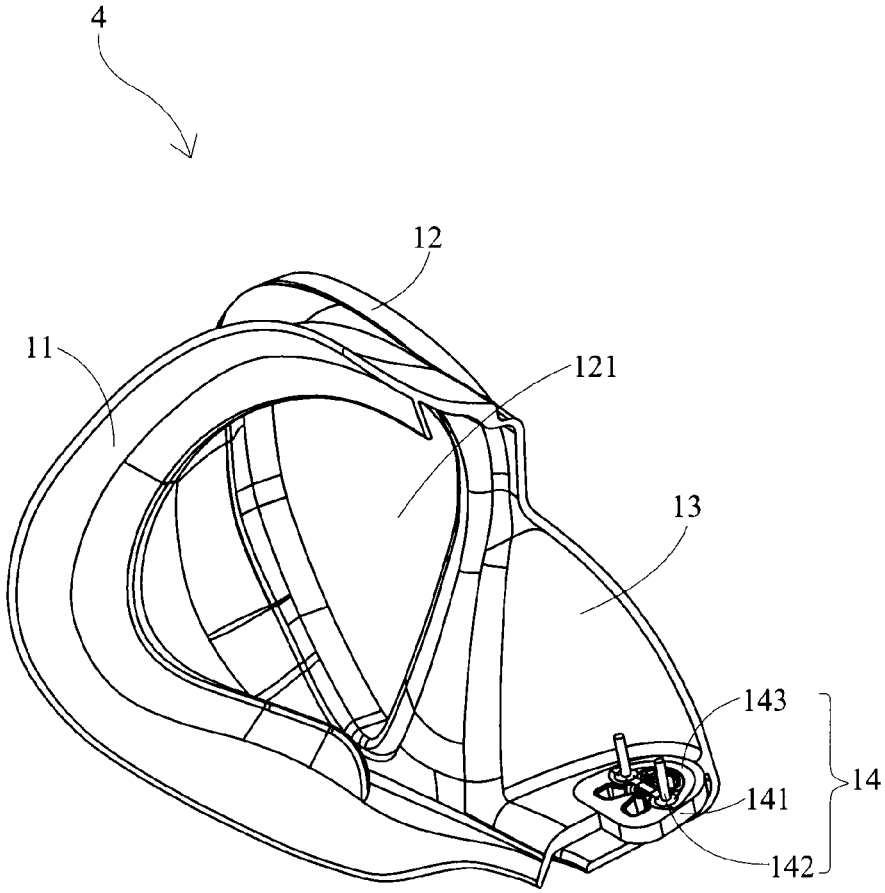
FIG. 8 is a cross-sectional assembly view of the fourth preferred embodiment of the goggle mask according to the present invention.
Figure 9:
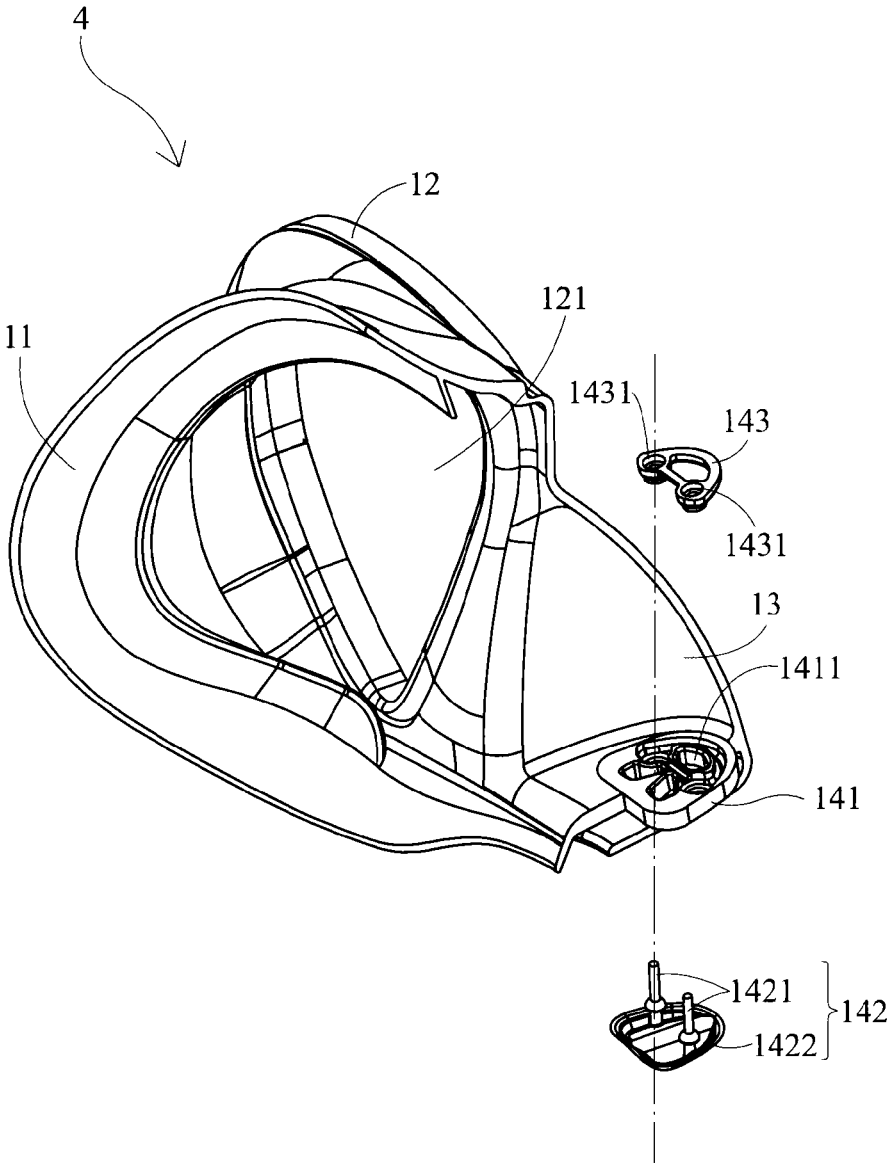
FIG. 9 is a cross-sectional exploded view of the fourth preferred embodiment of the goggle mask according to the present invention.

FIGS. 8 and 9 illustrate schematic views of the fourth preferred embodiment of the goggle mask of the present invention. The goggle mask 4 of this embodiment differs from the goggle mask 3 of the third embodiment in that the valve disk 142 of the check valve device 14 comprises two connecting rods 1421 both engaged with holes 1431 of the structural reinforcing component 143. This can increase the number of connections between the valve disk 142 and the structural reinforcing component 143 so that the valve disk 142 is less likely to be detached from the soft body 141.

Figure 10:
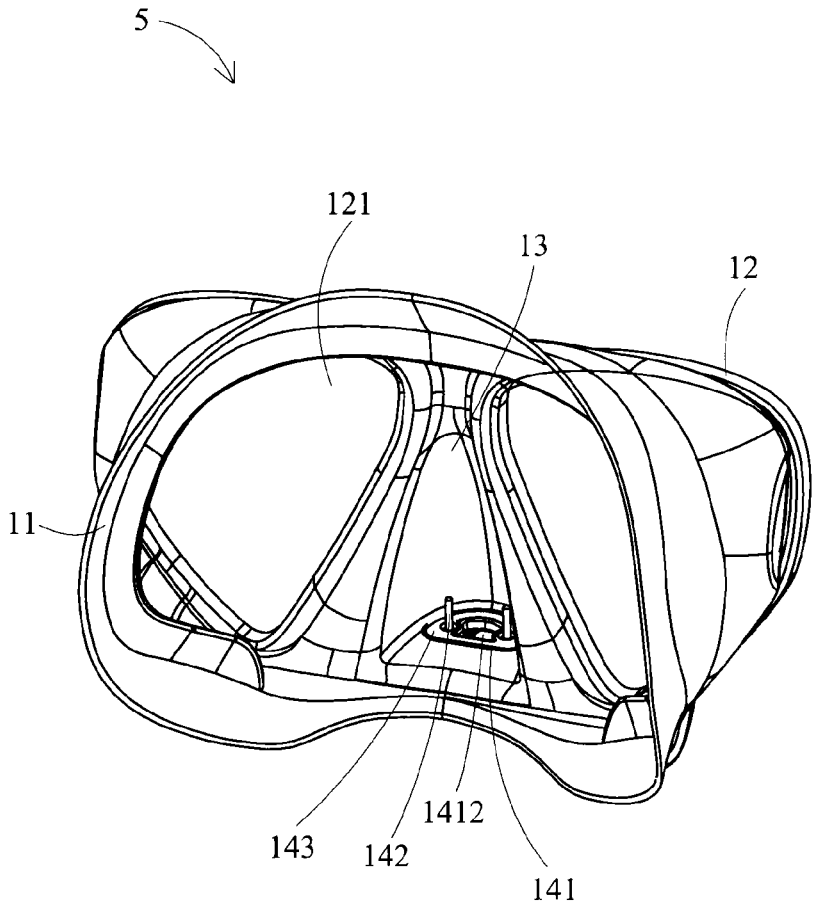
FIG. 10 is a perspective assembly view of the fifth preferred embodiment of the goggle mask according to the present invention.
Figure 11:
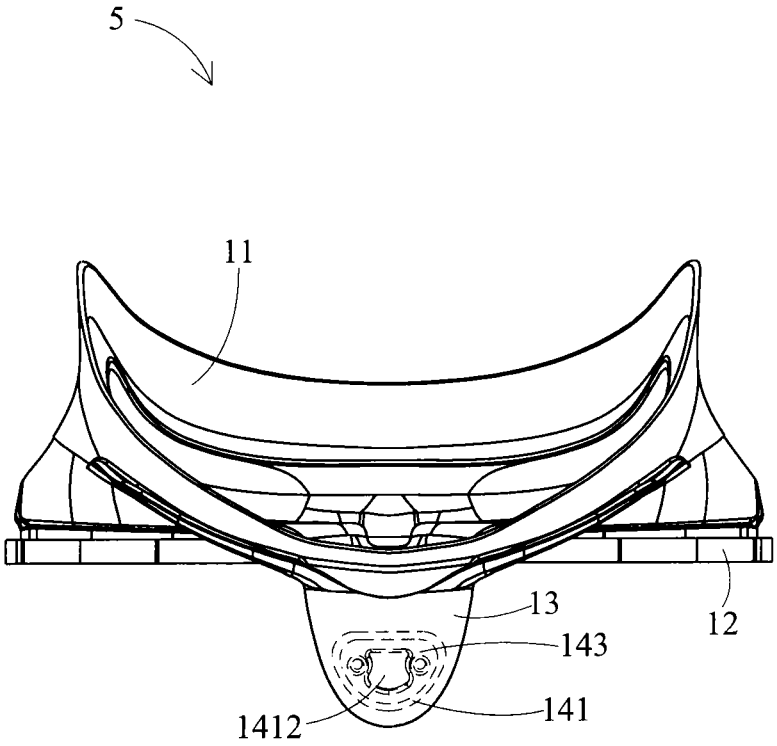
FIG. 11 is a bottom view of the fifth preferred embodiment of the goggle mask according to the present invention with the valve disk being omitted.

FIGS. 10 and 11 illustrate schematic views of the fifth preferred embodiment of the goggle mask according to the present invention. Similar to the fourth embodiment, the check valve device 14 of the goggle mask 5 of the fifth embodiment also comprises a soft body 141, a structural reinforcing component 143 and a valve disk 142. The soft body 141 also has a non-circular sectional shape corresponding to the sectional shape of the soft nose masking portion 13.

However, unlike the fourth embodiment, the soft body 141 has only a single draining hole 1412. The draining hole 1412 comprises no rib structure therein, so it has a large opening area. As a result, the draining hole 1412 presents a smaller resistance to the liquid flowing therethrough, and a smaller force can be used when the user exhales to drain the liquid out of the soft nose masking portion 13. Furthermore, as compared to the cases where a plurality of draining holes 1411 are provided (as shown in FIG. 5), the liquid flowing out through the single drain hole 1412 can flow in a uniform direction, which can speed up the draining of the liquid.

It is noting that the practice of providing a single draining hole 1412 is not limited for use only in this embodiment, but may also be used in the soft body 141 of the first embodiment and also used in cases where the body of the check valve device is made of a hard material (not shown).

Figure 12:
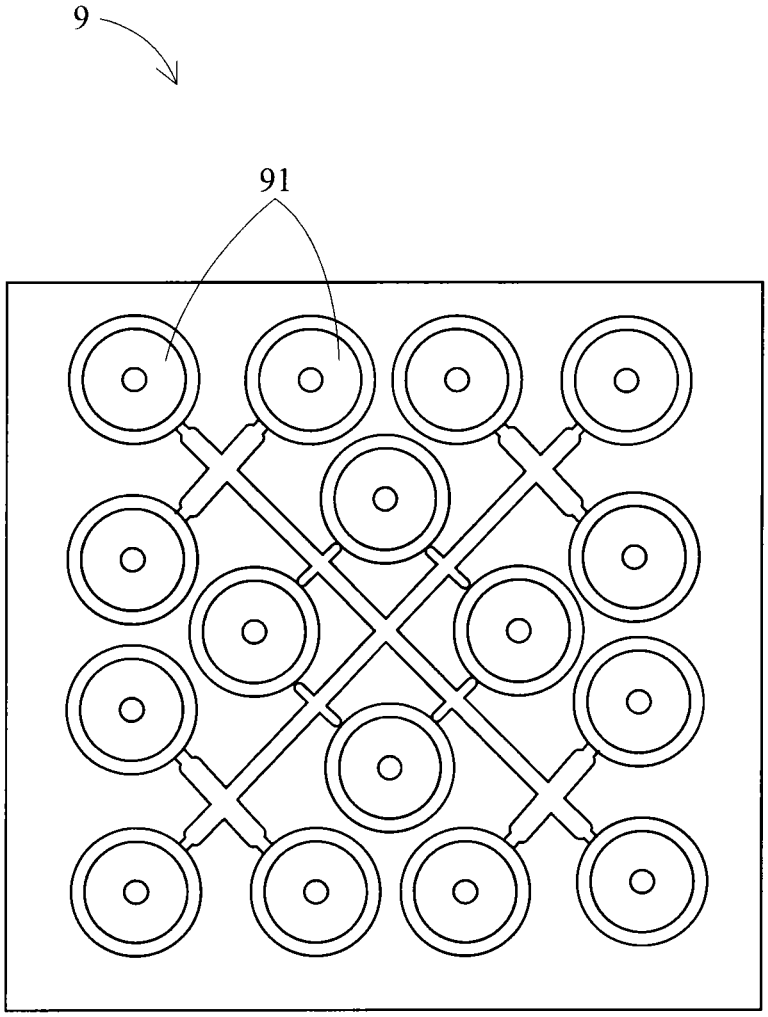
FIG. 12 is a schematic view of a mold for manufacturing a soft body in the third to the fifth embodiments of the goggle mask according to the present invention.

Next, a method for manufacturing the check valve device 14 of the third to the fifth embodiments will be described. In reference to FIGS. 5 to 11 together, the check valve device 14 can be manufactured at least through the following process: forming an annular structural reinforcing component 143 and locating it in the cavity 91 of a mold 9 (in reference to FIG. 12) for forming the soft body 141; injecting a raw material (e.g., PC, ABS or the like) of the soft body 141 into the cavity 91 to enclose the structural reinforcing component 143 so that after the raw material is solidified, the soft body 141 having the structural reinforcing component 143 enclosed therein is integrally formed (i.e., the structural reinforcing component 143 is securely enclosed by the soft body 141) in the cavity 91 and at least one draining hole 1411 of the soft body 141 is surrounded by the structural reinforcing component 143; then, taking the soft body 141 having the structural reinforcing component 143 enclosed therein out of the mold 9; and finally, connecting a valve disk 142 to the structural reinforcing component 143.

It is noting that because the mold 9 has a plurality of cavities 91, a plurality of soft bodies 141 each enclosing a structural reinforcing component 143 can be formed simultaneously in the mold 9.

It shall be appreciated that although only a single check valve device 14 is described as an example in the first to the fifth embodiments, two or more check valve devices 14 may be included in each of the goggle masks 1 to 5 in other embodiments (not shown) to improve the draining effect. Alternatively, a plurality of valve disks 141 may be disposed in a single check valve device 14 to improve the draining effect. In other words, the goggle masks 1 to 5 each comprise at least one check valve device 14 and each check valve device 14 comprises at least one valve disk 141.

Additionally, instead of comprising one lens 122 as shown in FIG. 4 or two lenses 121 as shown in FIG. 1 and FIG. 5, the frame portion 12 may also comprise three, four or more lenses in other embodiments (not shown). In other words, the frame portion 12 may comprise at least one lens.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A goggle mask, comprising:

a supporting portion;

a frame portion, disposed on the supporting portion;

a soft nose masking portion, disposed on the supporting portion; and at least one check valve device, disposed on an interior side of the soft nose masking portion, the check valve device including:

a soft body, integrally connected with the soft nose masking portion, and extending inwards from the interior side of the soft nose masking portion, the soft body being provided with at least one draining hole; and at least one valve disk, connected with the soft body, and configured to movably cover the at least one draining hole;

wherein the at least one valve disk includes a plurality of connecting rods and a movable piece, the movable piece is disposed at one end of the connecting rods and located on an exterior side of the soft body, and the movable piece movably covers the at least one draining hole.

2. The goggle mask of claim 1, wherein a hardness of each of the soft nose masking portion and the soft body is 15 A to 95 A Shore hardness.

3. The goggle mask of claim 1, wherein the soft body is made of a thermoplastic rubber, a thermoplastic polyurethane, a thermoplastic elastomer, a polyvinyl chloride, a silicone rubber or a combination thereof.

4. The goggle mask of claim 1, wherein the supporting portion and the soft nose masking portion are integrally connected with each other.

5. The goggle mask of claim 1, wherein a sectional shape of the soft body is non-circular and corresponds to a sectional shape of the soft nose masking portion.

6. The goggle mask of claim 1, wherein the soft body has the single draining hole.

7. A goggle mask, comprising:

a supporting portion;

a frame portion, disposed on the supporting portion;

a soft nose masking portion, disposed on the supporting portion; and at least one check valve device, disposed on an interior side of the soft nose masking portion, the check valve device including:

a soft body, integrally connected with the soft nose masking portion, extending inwards from the interior side of the soft nose masking portion, and having at least one draining hole;

a structural reinforcing component, enclosed by the soft body and harder than the soft body, wherein the at least one draining hole of the soft body is surrounded by the structural reinforcing component; and at least one valve disk, connected with the structural reinforcing component, and configured to movably cover the at least one draining hole;

wherein the at least one valve disk includes a plurality of connecting rods and a movable piece, the connecting rods are connected with the structural reinforcing component, the movable piece is disposed at one end of the connecting rods and located on an exterior side of the soft body, and the movable piece movably covers the at least one draining hole.

8. The goggle mask of claim 7, wherein a minimum distance between the structural reinforcing component and the supporting portion is 11 mm to 25 mm.

9. The goggle mask of claim 7, wherein a sectional shape of the soft body is non-circular and corresponds to a sectional shape of the soft nose masking portion.

10. The goggle mask of claim 7, wherein the soft body is made of a thermoplastic rubber, a thermoplastic polyurethane, a thermoplastic elastomer, a polyvinyl chloride, a silicone rubber or a combination thereof.

11. The goggle mask of claim 7, wherein the structural reinforcing component is made of a polycarbonate, an acrylonitrile butadiene styrene, Polyoxymethylene, Nylon, Polyurethane, Polypropylene or a combination thereof.

12. The goggle mask of claim 7, wherein a hardness of the structural reinforcing component is 40 A to 100 A Shore hardness.

13. The goggle mask of claim 7, wherein the soft body has the single draining hole.

* * * * *